US010279222B2

(12) United States Patent
Kamino et al.

(10) Patent No.: US 10,279,222 B2
(45) Date of Patent: May 7, 2019

(54) GOLF BALL

(71) Applicant: Dunlop Sports Co., Ltd., Kobe-shi, Hyogo (JP)

(72) Inventors: Kazuya Kamino, Kobe (JP); Kosuke Tachibana, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 96 days.

(21) Appl. No.: 14/981,418

(22) Filed: Dec. 28, 2015

(65) Prior Publication Data

US 2016/0184658 A1 Jun. 30, 2016

(30) Foreign Application Priority Data

Dec. 26, 2014 (JP) ..... 2014-266657

(51) Int. Cl.
*A63B 37/06* (2006.01)
*A63B 37/00* (2006.01)

(52) U.S. Cl.
CPC ..... *A63B 37/0092* (2013.01); *A63B 37/0031* (2013.01); *A63B 37/0033* (2013.01); *A63B 37/0037* (2013.01); *A63B 37/0039* (2013.01); *A63B 37/0043* (2013.01); *A63B 37/0045* (2013.01); *A63B 37/0049* (2013.01); *A63B 37/0062* (2013.01); *A63B 37/0063* (2013.01); *A63B 37/0064* (2013.01); *A63B 37/0075* (2013.01); *A63B 37/0096* (2013.01)

(58) Field of Classification Search
CPC ..... A63B 37/0049
USPC ..... 473/373, 374
See application file for complete search history.

(56) References Cited

U.S. PATENT DOCUMENTS

2003/0060307 A1 3/2003 Umezawa et al.
2012/0094783 A1* 4/2012 Okabe ..... A63B 37/0039 473/373
2012/0157235 A1 6/2012 Kimura
2013/0005508 A1* 1/2013 Matsuyama ..... A63B 37/0003 473/373

FOREIGN PATENT DOCUMENTS

JP 4816847 B2 11/2011
JP 2012-130676 A 7/2012

* cited by examiner

*Primary Examiner* — Raeann Gorden
(74) *Attorney, Agent, or Firm* — Birch, Stewart, Kolasch & Birch, LLP

(57) ABSTRACT

An object of the present invention is to provide a golf ball traveling a great flight distance on driver shots and an excellent shot feeling. The present invention provides a golf ball comprising a spherical core, an intermediate layer covering the spherical core, and a cover covering the intermediate layer, wherein a material hardness (Hm) of a resin composition constituting the intermediate layer ranges from 65 to 80 in Shore D hardness, a material hardness (Hc) of a resin composition constituting the cover ranges from 57 to 72 in Shore D hardness, a hardness difference (Hm−Hc) between the material hardness (Hm) and the material hardness (Hc) is more than 0, and the intermediate layer has a surface hardness satisfying a hardness difference (HmsC−HmsD) between a hardness thereof shown in Shore C hardness (HmsC) and a hardness thereof shown in Shore D hardness (HmsD) of 27 or less.

20 Claims, 1 Drawing Sheet

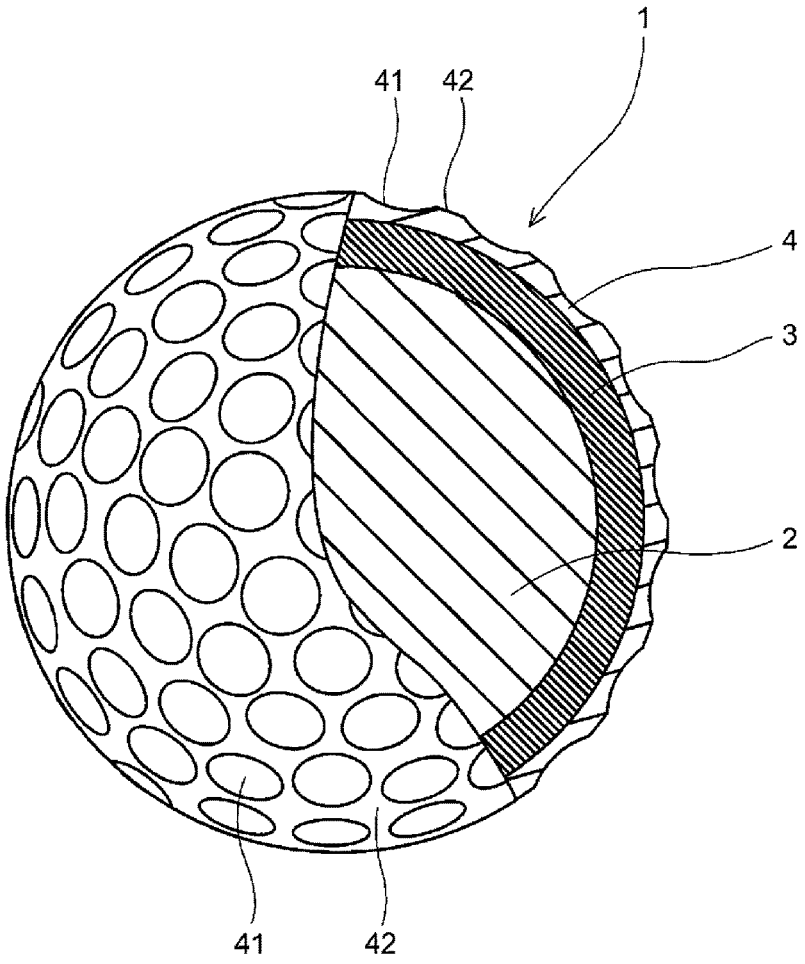
1
41
42
4
3
2
41
42

GOLF BALL

FIELD OF THE INVENTION

The present invention relates to a golf ball.

DESCRIPTION OF THE RELATED ART

Conventionally, various constructions of golf balls comprising three or more pieces have been proposed for required performances. For example, as a golf ball showing a good balance between the flight distance and the controllability performance, a golf ball employing an intermediate layer having the hardest material hardness and a cover having a soft hardness among the constituent members thereof has been proposed. For such golf balls, a high hardness resin such as an ionomer resin is mainly used as the intermediate layer material, and a low hardness resin such as a urethane resin is mainly used as the cover material.

For example, Japanese Patent No. 4816847 B discloses a multi-piece solid golf ball comprising an elastic solid core, a resin cover covering the elastic solid core and formed with a plurality of dimples, and a resin intermediate layer disposed between the elastic solid core and the cover, wherein when a deformation amount of the elastic solid core is defined as A, a deformation amount of a sphere consisting of the elastic solid core and the intermediate layer formed on the elastic solid core is defined as B, and a deformation amount of the golf ball is defined as C, each of these deformation amounts being a deformation amount (mm) obtained by applying a load from 98 N (10 kgf) as an initial load to 1274 N (130 kgf) as a final load, a relation of $1.14 \leq A/B \leq 1.30$ and a relation of $1.05 \leq B/C \leq 1.16$ are satisfied; and wherein the intermediate layer has a Shore D hardness ranging from 58 to 68, the cover layer is softer than the intermediate layer, and a Shore D hardness difference between the intermediate layer and the cover ranges from 7 to 16 (refer to Japanese Patent No. 4816847 B (claim 1)).

Japanese Patent Publication No. 2012-130676 A discloses a multi-piece solid golf ball comprising a core, at least one intermediate layer covering the core, and at least one cover layer covering the intermediate layer, wherein the core is formed from a base rubber, each layer of the intermediate layer and cover is formed from a resin material, a ratio (a)/(b) of a thickness (a) of the intermediate layer to a thickness (b) of the cover ranges from 0.7 to 1.9, a ratio (c)/(a) of the diameter (c) of the core to the thickness (a) of the intermediate layer ranges from 23 to 38, the intermediate layer has a material hardness ranging from 42 to 76 in Shore D, the cover has a material hardness ranging from 41 to 69 in Shore D, and the cover material hardness< the intermediate layer material hardness> the core surface hardness is satisfied (refer to Japanese Patent Publication No. 2012-130676 A (claim 1)).

In addition, as a golf ball for an average golfer, a golf ball focusing on a flight distance on driver shots has been proposed. As such a golf ball, a golf ball having a cover with the hardest material hardness and an intermediate layer with a relatively soft material hardness among the constituent members thereof has been proposed. In such a golf ball, since the high hardness cover lowers the shot feeling, the soft intermediate layer material is used to enhance the shot feeling.

SUMMARY OF THE INVENTION

As described above, various constructions of a golf ball have been studied. However, there is a need to further improve the flight distance on driver shots. For example, particularly in a golf ball for an average golfer, if the intermediate layer hardness is low, the spin rate on driver shots increases and thus the flight distance becomes short. The present invention has been achieved in view of the above circumstances, and an object of the present invention is to provide a golf ball showing a great flight distance on driver shots and an excellent shot feeling.

The present invention that has solved the above problems, provides a golf ball comprising a spherical core, an intermediate layer covering the spherical core, and a cover covering the intermediate layer, wherein a material hardness (Hm) of a resin composition constituting the intermediate layer ranges from 65 to 80 in Shore D hardness, a material hardness (Hc) of a resin composition constituting the cover ranges from 57 to 72 in Shore D hardness, a hardness difference (Hm−Hc) between the material hardness (Hm) and the material hardness (Hc) is more than 0, and the intermediate layer has a surface hardness satisfying a hardness difference (HmsC−HmsD) between a hardness thereof shown in Shore C hardness (HmsC) and a hardness thereof shown in Shore D hardness (HmsD) of 27 or less.

The golf ball according to the present invention shows a great flight distance on driver shots and an excellent shot feeling.

BRIEF DESCRIPTION OF THE DRAWINGS

FIG. 1 is a partially cutaway sectional view showing a golf ball of one embodiment according to the present invention.

DESCRIPTION OF THE PREFERRED EMBODIMENT

The golf ball according to the present invention comprises a spherical core, an intermediate layer covering the spherical core, and a cover covering the intermediate layer. Further, a material hardness (Hm) of a resin composition constituting the intermediate layer ranges from 65 to 80 in Shore D hardness, a material hardness (Hc) of a resin composition constituting the cover ranges from 57 to 72 in Shore D hardness, a hardness difference (Hm−Hc) between the material hardness (Hm) and the material hardness (Hc) is more than 0, and the intermediate layer has a surface hardness satisfying a hardness difference (HmsC−HmsD) between a hardness thereof shown in Shore C hardness (HmsC) and a hardness thereof shown in Shore D hardness (HmsD) of 27 or less. By adopting such a construction, the golf ball shows a great flight distance on driver shots and an excellent shot feeling.

[Construction]

The spherical core may be a single-layered construction or a multiple-layered construction. The spherical core is preferably formed from a rubber composition.

The center hardness (Ho) of the spherical core is preferably 15 or more, more preferably 18 or more, and even more preferably 21 or more, and is preferably 50 or less, more preferably 47 or less, and even more preferably 44 or less in Shore D hardness. If the center hardness of the spherical core is 15 or more in Shore D hardness, the resilience performance of the spherical core is further enhanced, and if the center hardness of the spherical core is 50 or less in Shore D hardness, the spin rate decrease effect on driver shots becomes larger.

The surface hardness (Hs) of the spherical core is preferably 35 or more, more preferably 38 or more, and even more preferably 41 or more, and is preferably 70 or less, more preferably 67 or less, and even more preferably 64 or less in Shore D hardness. If the surface hardness of the spherical core is 35 or more in Shore D hardness, the spin rate decrease effect on driver shots becomes larger, and if the surface hardness of the spherical core is 70 or less in Shore D hardness, the durability of the core is further enhanced.

The hardness difference (Hs−Ho) between the surface hardness (Hs) and the center hardness (Ho) of the spherical core is preferably 10 or more, more preferably 13 or more, and even more preferably 16 or more, and is preferably 40 or less, more preferably 37 or less, and even more preferably 34 or less in Shore D hardness. If the hardness difference (Hs−Ho) is 10 or more, the spin rate decrease effect on driver shots becomes larger, and if the hardness difference (Hs−Ho) is 40 or less, the resilience performance of the core is enhanced, and the durability becomes better as well.

The diameter of the spherical core is preferably 36.5 mm or more, more preferably 37.0 mm or more, and even more preferably 37.5 mm or more, and is preferably 42.2 mm or less. If the diameter of the spherical core is 36.5 mm or more, the spherical core is big, and thus the golf ball shows a higher resilience performance.

When the spherical core has a diameter ranging from 36.5 mm to 42.2 mm, the compression deformation amount of the core (shrinking amount of the core along the compression direction) when applying a load from 98 N as an initial load to 1275 N as a final load to the core is preferably 2.0 mm or more, more preferably 2.2 mm or more, and is preferably 5.0 mm or less, more preferably 4.8 mm or less. If the compression deformation amount is 2.0 mm or more, the shot feeling becomes better, and if the compression deformation amount is 5.0 mm or less, the resilience becomes better.

The intermediate layer is disposed between the spherical core and the cover, and formed from a resin composition. The intermediate layer may be a single-layered construction or a multiple-layered construction comprising two or more layers. It is noted that in case of comprising multiple intermediate layers, the material hardness (Hm) of the intermediate layer is the material hardness of the resin composition constituting the outermost intermediate layer, and the surface hardness of the intermediate layer is the surface hardness of the outermost intermediate layer.

In the golf ball according to the present invention, with respect to the surface hardness of a spherical body having the intermediate layer covering the spherical core, the difference (HmsC−HmsD) between the hardness (HmsC) measured with a Durometer type C prescribed in ASTM D 2240 and the hardness (HmsD) measured with a Durometer type D prescribed in ASTM D 2240 is 27 or less, preferably 26 or less, and more preferably 25 or less. The indenter tip of the Durometer type C has a cone frustum shape (angle: 35°, tip diameter: 0.79 mm), and thus has a wide contact point with the object to be measured. Accordingly, the Shore C hardness is considered to have a high correlation with the feeling. The indenter tip of the Durometer type D has a conical shape (angle: 30°, tip radius: 0.1 mm), and thus has a narrow contact point with the object to be measured. Accordingly, the Shore D hardness is considered to have a high correlation with the original hardness of the material and to have a high correlation with the spin performance.

The surface hardness (HmsC) reflects not only the material hardness of the intermediate layer, but also the surface hardness and the compression deformation amount of the spherical core. This surface hardness (HmsC) has a high correlation with the shot feeling of the golf ball, and a smaller value thereof means a better shot feeling. On the other hand, the surface hardness (HmsD) mainly reflects the material hardness of the intermediate layer. This surface hardness (HmsD) has a high correlation with the spin rate decrease effect, and a larger value thereof means a greater spin rate decrease effect. Therefore, a smaller difference (HmsC−HmsD) gives a better shot feeling and a greater spin rate decrease effect.

The surface hardness (HmsC) of the intermediate layer is preferably 93 or more, more preferably 95 or more, and even more preferably 96 or more, and is preferably 100 or less, more preferably 98 or less, and even more preferably 97 or less. If the surface hardness (HmsC) is 93 or more, the spin rate decrease effect on driver shots becomes greater, and if the surface hardness (HmsC) is 100 or less, the shot feeling on driver shots is excellent.

The surface hardness (HmsD) of the intermediate layer is preferably 66 or more, more preferably 68 or more, and even more preferably 70 or more, and is preferably 80 or less, more preferably 78 or less, and even more preferably 76 or less. If the surface hardness (HmsD) is 66 or more, the spin rate decrease effect on driver shots becomes greater, and if the surface hardness (HmsD) is 80 or less, the shot feeling on driver shots is excellent.

The material hardness (Hm) of the resin composition constituting the intermediate layer is 65 or more, preferably 67 or more, more preferably 69 or more, and is 80 or less in Shore D hardness. If the material hardness (Hm) is 65 or more in Shore D hardness, the spin rate on driver shots is lowered, and thus the flight distance improves. In addition, if the material hardness (Hm) is 80 or less in Shore D hardness, the shot feeling on driver shots is excellent.

The bending stiffness (Sm) of the resin composition constituting the intermediate layer is preferably 3000 kgf/cm$^2$ (294 MPa) or more, more preferably 3300 kgf/cm$^2$ (324 MPa) or more, and even more preferably 3600 kgf/cm$^2$ (353 MPa) or more, and is preferably 9000 kgf/cm$^2$ (883 MPa) or less, more preferably 8700 kgf/cm$^2$ (853 MPa) or less, and even more preferably 8400 kgf/cm$^2$ (824 MPa) or less. If the bending stiffness (Sm) is 3000 kgf/cm$^2$ or more, the spin rate decrease effect on driver shots becomes greater, and if the bending stiffness (Sm) is 9000 kgf/cm$^2$ or less, the shot feeling on driver shots is excellent.

The thickness of the intermediate layer is preferably 0.7 mm or more, more preferably 0.8 mm or more, and even more preferably 0.9 mm or more, and is preferably 1.5 mm or less, more preferably 1.4 mm or less, and even more preferably 1.3 mm or less. If the thickness of the intermediate layer is 0.7 mm or more, the spin rate decrease effect on driver shots becomes greater, and if the thickness of the intermediate layer is 1.5 mm or less, the shot feeling of the golf ball becomes better.

The cover constitutes the outermost layer of the golf ball body, and is formed from a resin composition. In the golf ball according to the present invention, with respect to the surface hardness of the cover, the difference (HcsC−HcsD) between the hardness (HcsC) measured with a Durometer type C prescribed in ASTM D 2240 and the hardness (HcsD) measured with a Durometer type D prescribed in ASTM D 2240 is preferably 27 or more, more preferably 28 or more. A larger difference (HcsC−HcsD) gives a more excellent shot feeling on driver shots.

The surface hardness (HcsC) of the cover is preferably 91 or more, more preferably 92 or more, and even more preferably 93 or more, and is preferably 98 or less, more preferably 97 or less, and even more preferably 96 or less. If the surface hardness (HcsC) is 91 or more, the resilience of the cover becomes high, and thus the flight distance on driver shots increases, and if the surface hardness (HcsC) is 98 or less, the shot feeling on driver shots is excellent.

The surface hardness (HcsD) of the cover is preferably 58 or more, more preferably 60 or more, and even more preferably 62 or more, and is preferably 72 or less, more preferably 70 or less, and even more preferably 68 or less.

If the surface hardness (HcsD) is 58 or more, the spin rate decrease effect on driver shots becomes greater, and if the surface hardness (HcsD) is 72 or less, the shot feeling on driver shots is excellent.

The material hardness (Hc) of the resin composition constituting the cover is 57 or more, preferably 59 or more, more preferably 61 or more, and is 72 or less, preferably 70 or less, more preferably 68 or less in Shore D hardness. If the material hardness (Hc) is 57 or more in Shore D hardness, the resilience of the cover becomes high, and thus the flight distance on driver shots increases. In addition, if the material hardness (Hc) is 72 or less in Shore D hardness, the shot feeling on driver shots is excellent.

The bending stiffness (Sc) of the resin composition constituting the cover is preferably 1500 kgf/cm$^2$ (147 MPa) or more, more preferably 1800 kgf/cm$^2$ (177 MPa) or more, and even more preferably 2100 kgf/cm$^2$ (206 MPa) or more, and is preferably 6000 kgf/cm$^2$ (588 MPa) or less, more preferably 5700 kgf/cm$^2$ (559 MPa) or less, and even more preferably 5400 kgf/cm$^2$ (530 MPa) or less. If the bending stiffness (Sc) is 1500 kgf/cm$^2$ or more, the resilience of the cover is high, and thus the flight distance on driver shots increases, and if the bending stiffness (Sc) is 6000 kgf/cm$^2$ or less, the shot feeling on driver shots is excellent.

The thickness of the cover is preferably 0.5 mm or more, more preferably 0.6 mm or more, and even more preferably 0.7 mm or more, and is preferably 1.3 mm or less, more preferably 1.2 mm or less, and even more preferably 1.1 mm or less. If the thickness of the cover is 0.7 mm or more, the durability of the cover increases, and if the thickness of the cover is 1.3 mm or less, the cover shows a higher resilience performance.

The difference (Hm−Hc) between the material hardness (Hc) and the material hardness (Hm) is more than 0, preferably 2 or more, more preferably 4 or more, and is preferably 20 or less, more preferably 18 or less, and even more preferably 16 or less. If the difference (Hm−Hc) is more than 0, the shot feeling on driver shots becomes better, and if the difference (Hm−Hc) is 20 or less, the spin rate decrease effect on driver shots becomes greater.

The ratio (Sm/Sc) of the bending stiffness (Sm) of the intermediate layer resin composition to the bending stiffness (Sc) of the cover resin composition is preferably 2 or more, more preferably 2.2 or more, and even more preferably 2.4 or more, and is preferably 5 or less, more preferably 4.8 or less, and even more preferably 4.6 or less. If the ratio (Sm/Sc) is 2 or more, the shot feeling on driver shots becomes better, and if the ratio (Sm/Sc) is 5 or less, the spin rate decrease effect on driver shots becomes greater.

The difference (Hm−Hs) between the surface hardness (Hs) of the spherical core and the material hardness (Hm) of the intermediate layer is preferably 10 or more, more preferably 12 or more, and even more preferably 14 or more, and is preferably 30 or less, more preferably 28 or less, and even more preferably 26 or less. If the difference (Hm−Hs) is 10 or more, the spin rate decrease effect on driver shots becomes greater, and if the difference (Hm−Hs) is 30 or less, the shot feeling on driver shots becomes better.

The difference (Hc−Hs) between the surface hardness (Hs) of the spherical core and the material hardness (Hc) of the cover is preferably 0 or more, more preferably 2 or more, and even more preferably 4 or more, and is preferably 20 or less, more preferably 18 or less, and even more preferably 16 or less. If the difference (Hc−Hs) is 0 or more, the resilience is high and thus the flight distance on driver shots increases, and if the difference (Hc−Hs) is 20 or less, the shot feeling on driver shots becomes better.

The golf ball according to the present invention preferably has a diameter ranging from 40 mm to 45 mm. In light of satisfying the regulation of US Golf Association (USGA), the diameter is particularly preferably 42.67 mm or more. In light of prevention of the air resistance, the diameter is more preferably 44 mm or less, and even more preferably 42.80 mm or less. In addition, the golf ball preferably has a mass of 40 g or more and 50 g or less. In light of obtaining greater inertia, the mass is more preferably 44 g or more, and even more preferably 45.00 g or more. In light of satisfying the regulation of USGA, the mass is particularly preferably 45.93 g or less.

When the golf ball according to the present invention has a diameter ranging from 40 mm to 45 mm, the compression deformation amount of the golf ball (shrinking amount of the golf ball along the compression direction) when applying a load from 98 N as an initial load to 1275 N as a final load to the golf ball is preferably 1.4 mm or more, more preferably 1.5 mm or more, even more preferably 1.6 mm or more, and most preferably 1.7 mm or more, and is preferably 4 mm or less, more preferably 3.8 mm or less. If the compression deformation amount is 1.4 mm or more, the golf ball does not become excessively hard, and thus the shot feeling thereof becomes better. On the other hand, if the compression deformation amount is 4 mm or less, the resilience of the golf ball becomes high.

Examples of the golf ball according to the present invention include a three-piece golf ball comprising a single-layered spherical core, a single-layered intermediate layer covering the spherical core, and a cover covering the intermediate layer; a four-piece golf ball comprising a two-layered spherical core, a single-layered intermediate layer covering the spherical core, and a cover covering the intermediate layer; a four-piece golf ball comprising a single-layered spherical core, two intermediate layers covering the spherical core, and a cover covering the intermediate layers; a golf ball having five pieces or more, specifically comprising a two-layered spherical core, two or more intermediate layers covering the spherical core, and a cover covering the intermediate layers. The present invention can be appropriately applied to any one of the above golf balls.

FIG. 1 is a partially cutaway sectional view showing a golf ball 1 according to one embodiment of the present invention. The golf ball 1 comprises a spherical core 2, an intermediate layer 3 disposed on the outer side of the spherical core 2, and a cover 4 disposed on the outer side of the intermediate layer 3. A plurality of dimples 41 are formed on the surface of the cover 4. Other portions than dimples 41 on the surface of the cover 4 are lands 42. The intermediate layer 3 is formed from a golf ball resin composition.

[Material]

The core, intermediate layer and cover of the golf ball may employ conventionally known materials.

The core may employ a conventionally known rubber composition (hereinafter, sometimes simply referred to as "core rubber composition"), and can be formed by, for example, heat-pressing a rubber composition containing a base rubber, a co-crosslinking agent, and a crosslinking initiator.

As the base rubber, typically preferred is a high cis-polybutadiene having cis-bond in a proportion of 40 mass % or more, more preferably 70 mass % or more, and even more preferably 90 mass % or more in view of its superior resilience property. The co-crosslinking agent is preferably an α,β-unsaturated carboxylic acid having 3 to 8 carbon atoms or a metal salt thereof, and more preferably a metal salt of acrylic acid or a metal salt of methacrylic acid. The metal constituting the metal salt is preferably zinc, magnesium, calcium, aluminum or sodium, more preferably zinc. The amount of the co-crosslinking agent is preferably 20 parts by mass or more and 50 parts by mass or less with respect to 100 parts by mass of the base rubber. When the α,β-unsaturated carboxylic acid having 3 to 8 carbon atoms is used as the co-crosslinking agent, a metal compound (e.g. magnesium oxide) is preferably used in combination. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

Further, the core rubber composition may further contain an organic sulfur compound. As the organic sulfur compound, diphenyl disulfides (e.g. diphenyl disulfide, bis (pentabromophenyl) persulfide), thiophenols, and thionaphthols (e.g. 2-thionaphthol) are preferably used. The amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber. In addition, the core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, an aliphatic carboxylic acid or an aromatic carboxylic acid (such as benzoic acid) can be used. The amount of the carboxylic acid and/or the salt thereof is preferably 1 part by mass or more and 40 parts by mass or less with respect to 100 parts by mass of the base rubber.

The intermediate layer and the cover are formed from a resin composition. The resin composition includes a thermoplastic resin as a resin component. Examples of the thermoplastic resin include an ionomer resin, a thermoplastic olefin copolymer, a thermoplastic polyamide, a thermoplastic polyurethane, a thermoplastic styrene resin, a thermoplastic polyester, a thermoplastic acrylic resin, a thermoplastic polyolefin, a thermoplastic polydiene, and a thermoplastic polyether. Among the thermoplastic resins, a thermoplastic elastomer having rubber elasticity is preferred. Examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

(Ionomer Resin)

Examples of the ionomer resin include an ionomer resin consisting of a metal ion-neutralized product of a binary copolymer composed of an olefin and an α,β-unsaturated carboxylic acid having 3 to 8 carbon atoms (hereinafter, sometimes referred to as "binary ionomer resin".); an ionomer resin consisting of a metal ion-neutralized product of a ternary copolymer composed of an olefin, an α,β-unsaturated carboxylic acid having 3 to 8 carbon atoms, and an α,β-unsaturated carboxylic acid ester (hereinafter, sometimes referred to as "ternary ionomer resin".); and a mixture of these ionomer resins.

The olefin is preferably an olefin having 2 to 8 carbon atoms, and examples thereof include ethylene, propylene, butene, pentene, hexene, heptene, and octene. Among them, ethylene is preferred. Examples of the α,β-unsaturated carboxylic acid having 3 to 8 carbon atoms include acrylic acid, methacrylic acid, fumaric acid, maleic acid and crotonic acid. Among them, acrylic acid and methacrylic acid are preferred.

As the α,β-unsaturated carboxylic acid ester, an alkyl ester of an α,β-unsaturated carboxylic acid having 3 to 8 carbon atoms is preferred, an alkyl ester of acrylic acid, methacrylic acid, fumaric acid or maleic acid is more preferred, and an alkyl ester of acrylic acid or an alkyl ester of methacrylic acid is particularly preferred. Examples of the alkyl group constituting the ester include methyl ester, ethyl ester, propyl ester, n-butyl ester, and isobutyl ester.

As the binary ionomer resin, a metal ion-neutralized product of an ethylene-(meth)acrylic acid binary copolymer is preferred. As the ternary ionomer resin, a metal ion-neutralized product of a ternary copolymer composed of ethylene, (meth)acrylic acid and (meth)acrylic acid ester is preferred. Herein, (meth)acrylic acid means acrylic acid and/or methacrylic acid.

Examples of the metal ion for neutralizing at least a part of carboxyl groups of the binary ionomer resin and/or the ternary ionomer resin include a monovalent metal ion such as sodium, potassium and lithium; a divalent metal ion such as magnesium, calcium, zinc, barium and cadmium; a trivalent metal ion such as aluminum; and other metal ion such as tin and zirconium. The binary ionomer resin and the ternary ionomer resin are preferably neutralized with at least one metal ion selected from the group consisting of $Na^+$, $Mg^{2+}$, $Ca^{2+}$ and $Zn^{2+}$.

Examples of the binary ionomer resin include Himilan (registered trademark) 1555 (Na), 1557 (Zn), 1605 (Na), 1706 (Zn), 1707 (Na), AM7311 (Mg) and AM7329 (Zn) (commercially available from Du Pont-Mitsui Polychemicals Co., Ltd.); Surlyn (registered trademark) 8945 (Na), 9945 (Zn), 8140 (Na), 8150 (Na), 9120 (Zn), 9150 (Zn), 6910 (Mg), 6120 (Mg), 7930 (Li), 7940 (Li) and AD8546 (Li) (commercially available from E.I. du Pont de Nemours and Company); and lotek (registered trademark) 8000 (Na), 8030 (Na), 7010 (Zn), 7030 (Zn) (commercially available from ExxonMobil Chemical Corporation).

Examples of the ternary ionomer resin include Himilan AM7327 (Zn), 1855 (Zn), 1856 (Na) and AM7331 (Na) (commercially available from Du Pont-Mitsui Polychemicals Co., Ltd.); Surlyn 6320 (Mg), 8120 (Na), 8320 (Na), 9320 (Zn), 9320W (Zn), HPF1000 (Mg) and HPF2000 (Mg) (commercially available from E.I. du Pont de Nemours and Company); and lotek 7510 (Zn) and 7520 (Zn) (commercially available from ExxonMobil Chemical Corporation).

(Thermoplastic Olefin Copolymer)

Examples of the thermoplastic olefin copolymer include a binary copolymer composed of an olefin and an α,β-unsaturated carboxylic acid having 3 to 8 carbon atoms (hereinafter, sometimes referred to as "binary copolymer".); a ternary copolymer composed of an olefin, an α,β-unsaturated carboxylic acid having 3 to 8 carbon atoms and an α,β-unsaturated carboxylic acid ester (hereinafter, sometimes referred to as "ternary copolymer".); and a mixture of these copolymers. The thermoplastic olefin copolymer is a nonionic copolymer having carboxyl groups not being neutralized.

Examples of the olefin include those olefins used for constituting the ionomer resin. In particular, ethylene is preferred. Examples of the α,β-unsaturated carboxylic acid having 3 to 8 carbon atoms and the ester thereof include those α,β-unsaturated carboxylic acids having 3 to 8 carbon atoms and the esters thereof used for constituting the ionomer resin.

As the binary copolymer, a binary copolymer composed of ethylene and (meth)acrylic acid is preferred. As the ternary copolymer, a ternary copolymer composed of ethylene, (meth)acrylic acid and (meth)acrylic acid ester is preferred.

Examples of the binary copolymer include Nucrel (registered trademark) N1050H, N2050H, N1110H and NO200H (commercially available from Du Pont-Mitsui Polychemicals Co., Ltd.); and Primacor (registered trademark) 5980I (commercially available from Dow Chemical Company). Examples of the ternary copolymer include Nucrel AN4318 and AN4319 (commercially available from Du Pont-Mitsui Polychemicals Co., Ltd.); and Primacor AT310 and AT320 (commercially available from Dow Chemical Company). It is noted that Na, Zn, Li, Mg or the like described in the parentheses after the trade name indicates a metal type of a neutralizing metal ion of the ionomer resin.

(Thermoplastic Polyamide and Thermoplastic Polyamide Elastomer)

The thermoplastic polyamide is not particularly limited, as long as it is a thermoplastic resin having a plurality of amide bonds (—NH—CO—) in the main molecular chain thereof. Examples of the thermoplastic polyamide include a product having amide bonds formed by a ring-opening polymerization of lactam or a reaction between a diamine component and a dicarboxylic acid component.

Examples of the thermoplastic polyamide include an aliphatic polyamide such as polyamide 6, polyamide 11, polyamide 12, polyamide 66, polyamide 610, polyamide 6T, polyamide 6I, polyamide 9T, polyamide M5T and polyamide 612; and an aromatic polyamide such as poly-p-phenylene terephthalamide and poly-m-phenylene isophthalamide. These thermoplastic polyam ides may be used solely, or two or more of these thermoplastic polyam ides may be used in combination. Among them, the aliphatic polyamide such as polyamide 6, polyamide 66, polyamide 11 and polyamide 12 is preferred.

The polyamide elastomer includes a hard segment part composed of a polyamide component, and a soft segment part. Examples of the soft segment part of the polyamide elastomer include a polyether ester component and a polyether component. Examples of the polyamide elastomer include a polyether ester amide obtained by a reaction between a polyamide component (hard segment component) and a polyether ester component (soft segment component) formed from a polyoxyalkylene glycol and a dicarboxylic acid; and a polyether amide obtained by a reaction between a polyamide component (hard segment component) and a polyether (soft segment component) formed from a dicarboxylic acid or a diamine and a polyoxyalkylene glycol being aminated or carboxylated at both terminals thereof.

Examples of the thermoplastic polyamide include Rilsan (registered trademark) B BESN TL, BESN P20 TL, BESN P40 TL, MB3610, BMF O, BMN O, BMN O TLD, BMN BK TLD, BMN P20 D, and BMN P40 D (commercially available from Arkema Inc.). Examples of the polyamide elastomer include PEBAX (registered trademark) 2533, 3533, 4033, and 5533 (commercially available from Arkema Inc.).

(Thermoplastic Styrene Elastomer)

As the thermoplastic styrene elastomer, a thermoplastic elastomer containing a styrene block is preferably used. The thermoplastic elastomer containing a styrene block includes a polystyrene block that is a hard segment, and a soft segment. The typical soft segment is a diene block. Examples of the constituent component of the diene block include butadiene, isoprene, 1,3-pentadiene and 2,3-dimethyl-1,3-butadiene. Among them, butadiene and isoprene are preferred. Two or more constituent components may be used in combination.

Examples of the thermoplastic elastomer containing a styrene block include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, and particularly preferably 15 mass % or more. In light of the shot feeling of the obtained golf ball, the content is preferably 50 mass % or less, more preferably 47 mass % or less, and particularly preferably 45 mass % or less.

Examples of the thermoplastic elastomer containing a styrene block include an alloy of one kind or two or more kinds selected from the group consisting of SBS, SIS, SIBS, SEBS, SEPS, SEEPS and the hydrogenated products thereof with a polyolefin. It is estimated that the olefin component in the alloy contributes to the improvement in compatibility with the ionomer resin. By using the alloy, the resilience performance of the golf ball is enhanced. An olefin having 2 to 10 carbon atoms is preferably used. Appropriate examples of the olefin include ethylene, propylene, butane and pentene. Ethylene and propylene are particularly preferred.

Specific examples of the polymer alloy include Rabalon (registered trademark) T3221C, T3339C, SJ4400N, SJ5400N, SJ6400N, SJ7400N, SJ8400N, SJ9400N, and SR04 (commercially available from Mitsubishi Chemical Corporation). Examples of the thermoplastic elastomer containing a styrene block include Epofriend A1010 (commercially available from Daicel Chemical Industries, Ltd.), and Septon HG-252 (commercially available from Kuraray Co., Ltd.).

The resin composition may further include an additive, for example, a pigment component such as a white pigment (e.g. titanium oxide) and a blue pigment, a weight adjusting agent, a dispersant, an antioxidant, an ultraviolet absorber, a light stabilizer, a fluorescent material or a fluorescent brightener. Examples of the weight adjusting agent include an inorganic filler such as zinc oxide, barium sulfate, calcium carbonate, magnesium oxide, tungsten powder, and molybdenum powder.

The content of the white pigment (e.g. titanium oxide) is preferably 0.5 part by mass or more, more preferably 1 part by mass or more, and is preferably 10 parts by mass or less, more preferably 8 parts by mass or less, with respect to 100 parts by mass of the thermoplastic resin. If the content of the white pigment is 0.5 part by mass or more, it is possible to impart the opacity to the obtained golf ball constituent member. If the content of the white pigment is more than 10 parts by mass, the durability of the obtained golf ball constituent member may deteriorate.

The resin composition can be obtained, for example, by dry blending the thermoplastic resin and the additive. Further, the dry blended mixture may be extruded into a pellet form. Dry blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single screw extruder.

The resin composition used for the intermediate layer preferably includes an ionomer resin and a polyamide resin as a resin component, and particularly preferably includes a binary ionomer resin and a polyamide resin. If the intermediate layer material includes an ionomer resin and a polyamide resin, the stiffness of the intermediate layer increases, the spin rate decrease effect becomes much greater, and thus the flight distance on driver shots further increases.

The total content of the ionomer resin and the polyamide resin in the resin component of the resin composition used for the intermediate layer is preferably 90 mass % or more, more preferably 94 mass % or more, and even more preferably 98 mass % or more.

The mass ratio (ionomer resin/polyamide resin) of the ionomer resin to the polyamide resin in the resin composition used for the intermediate layer preferably ranges from 90/10 to 50/50, more preferably ranges from 85/15 to 55/45, and even more preferably ranges from 80/20 to 60/40. If the mass ratio of the ionomer resin to the polyamide resin falls within the above range, the spin rate on driver shots decreases due to the high bending elasticity, and the flight distance on driver shots becomes greater due to the good resilience.

The resin composition used for the cover preferably includes an ionomer resin as a resin component, and particularly preferably includes a binary ionomer resin. If the cover material includes an ionomer resin, the resilience of the cover further increases, and thus the flight distance on driver shots becomes greater.

The content of the ionomer resin in the resin component of the resin composition used for the cover is preferably 70 mass % or more, more preferably 75 mass % or more, and even more preferably 80 mass % or more.

[Production Method]

The molding conditions for heat-pressing the core rubber composition should be determined appropriately depending on the formulation of the rubber composition. Generally, it is preferred that the molding is carried out by heating the core rubber composition at a temperature ranging from 130° C. to 200° C. for 10 minutes to 60 minutes, alternatively, by molding the core rubber composition in a two-step heating, i.e. at a temperature ranging from 130° C. to 150° C. for 20 minutes to 40 minutes, and then at a temperature ranging from 160° C. to 180° C. for 5 minutes to 15 minutes.

The method for molding the intermediate layer is not particularly limited, and examples thereof include a method of molding the resin composition into semispherical half shells in advance, covering the core with two of the half shells, and performing compression molding; and a method of injection molding the resin composition directly onto the core to cover the core.

When injection molding the resin composition onto the core to mold the intermediate layer, it is preferred to use upper and lower molds having a semispherical cavity. Injection molding of the intermediate layer can be carried out by protruding the hold pin to hold the spherical body to be covered, charging the heated and melted resin composition, and then cooling to obtain the intermediate layer.

When molding the intermediate layer by the compression molding method, the half shell can be molded by either the compression molding method or the injection molding method, but the compression molding method is preferred. Compression molding the resin composition into half shells can be carried out, for example, under a pressure of 1 MPa or more and 20 MPa or less at a molding temperature of −20° C. or more and 70° C. or less relative to the flow beginning temperature of the resin composition. By carrying out the molding under the above conditions, the half shells with a uniform thickness can be formed. Examples of the method for molding the intermediate layer with half shells include a method of covering the spherical body with two of the half shells and then performing compression molding. Compression molding the half shells into the intermediate layer can be carried out, for example, under a molding pressure of 0.5 MPa or more and 25 MPa or less at a molding temperature of −20° C. or more and 70° C. or less relative to the flow beginning temperature of the resin composition. By carrying out the molding under the above conditions, the intermediate layer with a uniform thickness can be formed.

The embodiment for molding the resin composition into the cover is not particularly limited, and examples thereof include an embodiment of injection molding the resin composition directly onto the intermediate layer; and an embodiment of molding the resin composition into hollow shells, covering the intermediate layer with a plurality of the hollow shells, and performing compression molding (preferably an embodiment of molding the resin composition into hollow half shells, covering the intermediate layer with two of the half shells, and performing compression molding). The golf ball body having the cover formed thereon is ejected from the mold, and as necessary, is preferably subjected to surface treatments such as deburring, cleaning and sandblast. Further, if desired, a mark may be formed thereon.

The total number of the dimples formed on the cover is preferably 200 or more and 500 or less. If the total number of the dimples is less than 200, the dimple effect is hardly obtained. On the other hand, if the total number of the dimples exceeds 500, the dimple effect is hardly obtained because the size of the respective dimples is small. The shape (shape in a plan view) of the formed dimples includes, for example, without limitation, a circle; a polygonal shape such as a roughly triangular shape, a roughly quadrangular shape, a roughly pentagonal shape, and a roughly hexagonal shape; and other irregular shape. The shape of the dimples may be employed solely, or two or more of the shapes may be employed in combination.

The paint film preferably has a thickness of, but not particularly limited to, 5 μm or more, more preferably 7 μm or more, and preferably has a thickness of 50 μm or less, more preferably 40 μm or less, and even more preferably 30 μm or less. If the thickness of the paint film is less than 5 μm, the paint film is easy to wear off due to continued use of the golf ball, and if the thickness of the paint film is more than 50 μm, the dimple effect is reduced, and thus the flight performance of the golf ball may deteriorate.

EXAMPLES

Hereinafter, the present invention will be described in detail by way of examples. However, the present invention is not limited to the examples described below, and various changes and modifications can be made without departing from the spirit and scope of the present invention.

[Evaluation Method]

(1) Core Hardness, Intermediate Layer Hardness and Cover Hardness

The hardness measured on the surface of the core was adopted as the surface hardness of the core. In addition, the core was cut into two semispheres to obtain a cut plane, and the hardness measured at the central point of the cut plane was adopted as the center hardness of the core. The hardness measured on the surface of the intermediate layer formed on the core was adopted as the surface hardness of the intermediate layer. The hardness measured on the surface of the cover (land part) formed on the intermediate layer was adopted as the surface hardness of the cover. The hardness was measured with an automatic hardness tester (Digitest II, commercially available from H. Barleys Company). "Shore D" or "Shore C" was used as the detector.

(2) Material Hardness

Sheets with a thickness of about 2 mm were produced by injection molding the resin composition, and then stored at 23° C. for two weeks. Three or more of these sheets were stacked on one another so as not to be affected by the measuring substrate on which the sheets were placed, and the hardness of the stack was measured with an automatic hardness tester (Digitest II, commercially available from H. Barleys Company). "Shore D" or "Shore C" was used as the detector.

(3) Bending Stiffness

The test piece with a thickness of about 2 mm, a width of 20 mm and a length of 100 mm were produced by injection molding the resin composition, and then stored at 23° C. for two weeks. The bending stiffness was measured according to JIS K 7106 (1995). The measurement was carried out under the conditions of temperature: 23° C., humidity: 50% RH, and a distance between the fulcrum and the measurement point: 50 mm.

(4) Compression Deformation Amount

The compression deformation amount of the golf ball or the core along the compression direction (shrinking amount of the golf ball or the core along the compression direction), when applying a load from 98 N as an initial load to 1275 N as a final load to the golf ball or the core, was measured.

(5) Shot Feeling on Driver Shots

The golf ball was hit by thirty golfers using a driver (trade name: "XXIO8", shaft hardness: R, loft angle: 10.5°, commercially available from Dunlop Sports Limited), and the shot feeling thereof was evaluated. In accordance with the number of the golfers who answered the shot feeling was good, the golf ball was evaluated according to the following standard.

E (excellent): 25 or more

G (good): 20 to 24

F (fair): 15 to 19

P (poor): less than 15

(6) Spin Rate, Ball Initial Velocity and Flight Distance on Driver Shots

A driver (trade name: "XXIO8", shaft hardness: R, loft angle: 10.5°, commercially available from Dunlop Sports Limited) was installed on a swing robot M/C commercially available from Golf Laboratories, Inc. The golf ball was hit at a head speed of 40 m/sec, and the ball initial velocity (m/s) and the spin rate (rpm) right after hitting the golf ball, and the flight distance (the distance (m) from the launch point to the stop point) were measured. This measurement was conducted twelve times for each golf ball, and the average value thereof was adopted as the measurement value for the golf ball. A sequence of photographs of the hit golf ball were taken for measuring the spin rate right after hitting the golf ball.

[Production of Golf Ball]

(1) Production of Core

The core rubber compositions having the formulations shown in Table 1 were mixed and kneaded, and then heat-pressed under the conditions shown in Table 2 to produce the spherical cores or the spherical inner cores. The two-layered core was produced as follows. The core rubber composition having the formulation shown in Table 1 was mixed and kneaded, and molded into half shells. The above inner core was covered with two of the half shells. The inner core and the half shells were charged together into the mold consisting of upper and lower molds having a semispherical cavity, and then heat-pressed under the conditions shown in Table 2. It is noted that the amount of barium sulfate in Table 1 was adjusted such that the golf ball had a mass of 45.6 g.

TABLE 1

| | | Rubber composition No. | | |
|---|---|---|---|---|
| | | a | b | c |
| Formulation (parts by mass) | Polybutadiene rubber | 100 | 100 | 100 |
| | Zinc acrylate | 34.5 | — | 20 |
| | Methacrylic acid | — | 28 | — |
| | Magnesium oxide | — | 35 | — |
| | Zinc oxide | 12 | — | 12 |
| | Barium sulfate | Appropriate amount | — | Appropriate-amount |
| | 2-Thionaphtol | 0.1 | — | 0.1 |
| | Diphenyldisulfide | — | — | — |
| | Bis(pentabromophenyl) persulfide | 0.3 | — | — |
| | Dicumyl peroxide | 0.8 | 0.9 | 0.9 |
| | Benzoic acid | 2 | — | 2 |

| | | Rubber composition No. | | |
|---|---|---|---|---|
| | | d | e | f |
| Formulation (parts by mass) | Polybutadiene rubber | 100 | 100 | 100 |
| | Zinc acrylate | 36 | 44 | 27.5 |
| | Methacrylic acid | — | — | — |
| | Magnesium oxide | — | — | — |
| | Zinc oxide | 5 | 5 | 12 |
| | Barium sulfate | Appropriate amount | Appropriate amount | Appropriate amount |
| | 2-Thionaphtol | 0.2 | — | 0.1 |
| | Diphenyldisulfide | — | 0.5 | — |
| | Bis(pentabromophenyl) persulfide | — | — | 0.4 |
| | Dicumyl peroxide | 0.8 | 0.7 | 0.9 |
| | Benzoic acid | 2 | — | 2 |

Polybutadiene rubber: "BR-730 (high-cis polybutadiene)" commercially available from JSR Corporation
Zinc acrylate: "ZNDA-90S" commercially available from Nihon Jyoryu Kogyo Co., Ltd.
Magnesium oxide: "MAGSARAT (registered trademark) 150ST" commercially available from Kyowa Chemical Industry Co., Ltd.
Methacrylic acid: commercially available from Mitsubishi Rayon Co., Ltd.
Zinc oxide: "Ginrei R" commercially available from Toho Zinc Co., Ltd.
Barium sulfate: "Barium Sulfate BD" commercially available from Sakai Chemical Industry Co., Ltd.
2-Thionaphtol: commercially available from Zhejiang shou & Fu Chemical Co., Ltd.
Diphenyldisulfide: commercially available from Sumitomo Seika Chemicals Co., Ltd.
Bis(pentabromophenyl) persulfide: commercially available from Kawaguchi Chemical Industry Co., Ltd.
Dicumyl peroxide: "Percumyl (registered trademark) D" commercially available from NOF Corporation
Benzoic acid: commercially available from Emerald Kalama Chemical Co., Ltd.

TABLE 2

| | | | Core No. | | | |
|---|---|---|---|---|---|---|
| | | | I | II | III | IV |
| Inner layer | Rubber composition No. | | — | b | c | — |
| | Heating condition | Temperature (° C.) | — | 170 | 150 | — |
| | | Time (min) | — | 20 | 15 | — |
| | Diameter (mm) | | — | 15 | 24 | — |
| Outer layer | Rubber composition No. | | a | d | e | f |
| | Heating condition 1 | Temperature (° C.) | 150 | 150 | 140 | 160 |
| | | Time (min) | 20 | 20 | 25 | 18 |
| | Heating condition 2 | Temperature (° C.) | — | — | 160 | — |
| | | Time (min) | — | — | 10 | — |

(2) Preparation of Resin Composition

Materials having the formulations shown in Table 3 were mixed with a twin-screw kneading extruder to prepare the resin compositions in a pellet form. The extruding conditions were a screw diameter of 45 mm, a screw rotational speed of 200 rpm, and a screw L/D=35, and the mixture was heated to 160° C. to 230° C. at the die position of the extruder.

TABLE 3

| | | Resin composition No. | | | | |
|---|---|---|---|---|---|---|
| | | A | B | C | D | E |
| Formulation (parts by mass) | Polyamide 6 | 35 | — | — | — | — |
| | Surlyn 8150 | 32.5 | 25 | — | — | — |
| | Surlyn 9150 | 32.5 | — | — | — | — |
| | Himilan 1555 | — | — | — | 10 | — |
| | Himilan 1605 | — | 25 | 47 | — | — |
| | Himilan AM7329 | — | 50 | 50 | 55 | 40 |
| | Himilan AM7337 | — | — | — | 5 | 43 |
| | Rabalon T3221C | — | — | 3 | — | 17 |
| | Nucrel N1050H | — | — | — | 30 | — |
| | Barium sulfate | Appropriate amount | Appropriate amount | Appropriate amount | Appropriate amount | Appropriate amount |
| | Titanium dioxide | 4 | 4 | 4 | 3 | 6 |
| Bending stiffness (kgf/cm$^2$) | | 7000 | 3600 | 2700 | 2100 | 1400 |
| Material hardness (Shore D) | | 72 | 66 | 63 | 61 | 55 |

Polyamide 6: "CM1017K" commercially available from Toray Industries, Inc.

Surlyn 8150: sodium ion-neutralized ethylene-methacrylic acid copolymer ionomer resin commercially available from E.I. du Pont de Nemours and Company Surlyn 9150: zinc ion-neutralized ethylene-methacrylic acid copolymer ionomer resin commercially available from E.I. du Pont de Nemours and Company Himilan 1555: sodium ion-neutralized ethylene-methacrylic acid copolymer ionomer resin commercially available from Du Pont-Mitsui Polychemicals Co., Ltd.

Himilan 1605: sodium ion-neutralized ethylene-methacrylic acid copolymer ionomer resin commercially available from Du Pont-Mitsui Polychemicals Co., Ltd.

Himilan AM7329: zinc ion-neutralized ethylene-methacrylic acid copolymer ionomer resin commercially available from Du Pont-Mitsui Polychemicals Co., Ltd.

Himilan AM7337: sodium ion-neutralized ethylene-methacrylic acid copolymer ionomer resin commercially available from Du Pont-Mitsui Polychemicals Co., Ltd.

Rabalon T3221C: thermoplastic styrene elastomer commercially available from Mitsubishi Chemical Corporation Nucrel N1050H: ethylene-methacrylic acid copolymer commercially available from Du Pont-Mitsui Polychemicals Co., Ltd.

(2) Production of Intermediate Layer

The resin composition shown in Table 3 was injection molded on the above obtained core to form the intermediate layer.

(3) Production of Cover

The resin compositions shown in Table 3 were injection molded on the above obtained spherical bodies having the intermediate layer covered thereon to form the cover. In addition, the mold having a plurality of pimples on the cavity surface thereof was used, and a plurality of dimples having a reversed shape of the pimple shape were formed on the molded cover.

The evaluation results of the obtained golf balls are shown in Table 4.

TABLE 4

| | | | Golf ball No. | | | | | |
|---|---|---|---|---|---|---|---|---|
| | | | 1 | 2 | 3 | 4 | 5 | 6 |
| Core | | Core No. | I | II | III | IV | I | II |
| | | Diameter (mm) | 39.1 | 39 | 38.7 | 38.6 | 39 | 38.7 |
| | | Center hardness (Shore D) | 30 | 33 | 35 | 24 | 30 | 33 |
| | | Surface hardness (Shore D) | 56 | 56 | 55 | 52 | 56 | 56 |
| | | Surface hardness (Shore C) | 86 | 86 | 85 | 82 | 86 | 86 |
| | | Hardness difference (surface − core) (Shore D) | 26 | 23 | 20 | 28 | 26 | 23 |
| | | Compression deformation amount (mm) | 3.2 | 2.8 | 2.6 | 4.1 | 3.2 | 2.8 |
| Intermediate layer | Material | Resin composition No. | A | A | A | A | C | B |
| | | Material hardness (Shore C) | 96 | 96 | 96 | 96 | 91 | 92 |
| | | Material hardness Hm (Shore D) | 72 | 72 | 72 | 72 | 63 | 66 |
| | | Bending stiffness Sm (kgf/cm$^2$) | 7000 | 7000 | 7000 | 7000 | 2700 | 3600 |
| | | Surface hardness HmsC (Shore C) | 97 | 97 | 97 | 97 | 93 | 94 |
| | | Surface hardness HmsD (Shore D) | 73 | 73 | 73 | 73 | 65 | 68 |
| | | HmsC − HmsD | 24 | 24 | 24 | 24 | 28 | 26 |
| | | Thickness Tm (mm) | 0.8 | 1.0 | 1.0 | 1.2 | 1.0 | 1.0 |
| Cover | Material | Resin composition No. | C | D | C | D | D | A |
| | | Material hardness (Shore C) | 91 | 90 | 91 | 90 | 90 | 96 |
| | | Material hardness Hc (Shore D) | 63 | 61 | 63 | 61 | 61 | 72 |
| | | Bending stiffness Sc (kgf/cm$^2$) | 2700 | 2100 | 2700 | 2100 | 2100 | 7000 |
| | | Surface hardness HcsC (Shore C) | 93 | 92 | 93 | 92 | 92 | 97 |
| | | Surface hardness HcsD (Shore D) | 65 | 63 | 65 | 63 | 63 | 73 |
| | | HcsC − HcsD | 28 | 29 | 28 | 29 | 29 | 24 |
| | | Thickness Tc (mm) | 1.0 | 0.85 | 1.0 | 0.85 | 0.85 | 1.0 |
| Hardness difference (Hm − Hc) | | | 9 | 11 | 9 | 11 | 2 | −6 |
| Ratio (Sm/Sc) | | | 2.6 | 3.3 | 2.6 | 3.3 | 1.3 | 0.5 |

TABLE 4-continued

| | | | | | | | | |
|---|---|---|---|---|---|---|---|---|
| Evaluation | Compression deformation amount (mm) | | 1.9 | 2 | 1.9 | 3.2 | 2 | 1.9 |
| | On driver shots | Shot feeling | G | G | G | E | G | P |
| | | Ball velocity (m/s) | 58.7 | 58.7 | 59 | 57.7 | 58.5 | 58.8 |
| | | Spin rate (rpm) | 2400 | 2300 | 2400 | 2000 | 2550 | 2200 |
| | | Flight distance (yd) | 228.5 | 229.5 | 230 | 227.5 | 226 | 231 |

| | | | Golf ball No. | | | | |
|---|---|---|---|---|---|---|---|
| | | | 7 | 8 | 9 | 10 | 11 |
| Core | | Core No. | I | II | IV | II | II |
| | | Diameter (mm) | 37.9 | 39.5 | 39 | 38.7 | 39.5 |
| | | Center hardness (Shore D) | 30 | 33 | 24 | 33 | 33 |
| | | Surface hardness (Shore D) | 56 | 56 | 52 | 56 | 56 |
| | | Surface hardness (Shore C) | 86 | 86 | 82 | 86 | 86 |
| | | Hardness difference (surface − core) (Shore D) | 26 | 23 | 28 | 23 | 23 |
| | | Compression deformation amount (mm) | 3.2 | 2.8 | 4.1 | 2.8 | 2.8 |
| Intermediate layer | Material | Resin composition No. | A | A | E | B | B |
| | | Material hardness (Shore C) | 96 | 96 | 84 | 92 | 92 |
| | | Material hardness Hm (Shore D) | 72 | 72 | 55 | 66 | 66 |
| | | Bending stiffness Sm (kgf/cm$^2$) | 7000 | 7000 | 1400 | 3600 | 3600 |
| | | Surface hardness HmsC (Shore C) | 97 | 97 | 91 | 94 | 94 |
| | | Surface hardness HmsD (Shore D) | 73 | 73 | 62 | 68 | 66 |
| | | HmsC − HmsD | 24 | 24 | 29 | 26 | 28 |
| | | Thickness Tm (mm) | 1.0 | 0.6 | 1.0 | 1.0 | 0.4 |
| Cover | Material | Resin composition No. | B | C | D | E | D |
| | | Material hardness (Shore C) | 92 | 91 | 90 | 84 | 90 |
| | | Material hardness Hc (Shore D) | 66 | 63 | 61 | 55 | 61 |
| | | Bending stiffness Sc (kgf/cm$^2$) | 3600 | 2700 | 2100 | 1400 | 2100 |
| | | Surface hardness HcsC (Shore C) | 94 | 93 | 92 | 91 | 92 |
| | | Surface hardness HcsD (Shore D) | 68 | 65 | 63 | 62 | 63 |
| | | HcsC − HcsD | 26 | 28 | 29 | 29 | 29 |
| | | Thickness Tc (mm) | 1.4 | 1.0 | 0.85 | 1.0 | 1.2 |
| | Hardness difference (Hm − Hc) | | 6 | 9 | −6 | 11 | 5 |
| | Ratio (Sm/Sc) | | 1.9 | 2.6 | 0.7 | 2.6 | 1.7 |
| Evaluation | Compression deformation amount (mm) | | 1.8 | 2 | 3.4 | 2.1 | 2.3 |
| | On driver shots | Shot feeling | F | G | E | E | E |
| | | Ball velocity (m/s) | 59 | 58.6 | 57.5 | 58.3 | 57.8 |
| | | Spin rate (rpm) | 2600 | 2550 | 2200 | 2550 | 2600 |
| | | Flight distance (yd) | 228 | 226.5 | 224.5 | 225 | 222 |

Golf balls No. 1 to No. 4, No. 7 and No. 8 are the cases where the material hardness (Hm) (Shore D) ranges from 65 to 80, the material hardness (Hc) (Shore D) ranges from 57 to 72, the difference (Hm − Hc) is more than 0, and the difference (HmsC − HmsD) is 27 or less. All of these golf balls show a great flight distance on driver shots and an excellent shot feeling. Among them, Golf balls No. 1 to No. 4 and No. 8 having the difference (HcsC − HcsD) of 27 or more show a more excellent shot feeling.
Golf balls No. 5 and No. 9 are the cases where the material hardness (Hm) (Shore D) is less than 65, and show a low flight distance on driver shots. Golf ball No. 6 is the case where the difference (Hm − Hc) is 0 or less, and shows a worse shot feeling. Golf ball No. 10 is the case where the material hardness (Hc) (Shore D) is less than 57, and shows a high spin rate and a low flight distance on driver shots. Golf ball No. 11 is the case where the difference (HmsC − HmsD) is more than 27, and shows a high spin rate and a low flight distance on driver shots.

This application is based on Japanese Patent Application No. 2014-266657 filed on Dec. 26, 2014, the contents of which are hereby incorporated by reference.

The invention claimed is:

1. A golf ball comprising a spherical core, an intermediate layer covering the spherical core, and a cover covering the intermediate layer, wherein:

a material hardness (Hm) of a resin composition constituting the intermediate layer ranges from 65 to 80 in Shore D hardness, a material hardness (Hc) of a resin composition constituting the cover ranges from 57 to 72 in Shore D hardness, a hardness difference (Hm−Hc) between the material hardness (Hm) and the material hardness (Hc) is more than 0, the intermediate layer has a surface hardness satisfying a hardness difference (HmsC−HmsD) between a hardness thereof shown in Shore C hardness (HmsC) and a hardness thereof shown in Shore D hardness (HmsD) of 27 or less, a ratio (Sm/Sc) of a bending stiffness (Sm) of the resin composition constituting the intermediate layer to a bending stiffness (Sc) of the resin composition constituting the cover is 2 or more, and a resin component of the resin composition constituting the intermediate layer consists of a polyamide resin and an ionomer resin, wherein the polyamide resin is at least one member selected from the group consisting of polyamide 6, polyamide 11, polyamide 12, polyamide 66, polyamide 610, polyamide 6T, polyamide 6I, polyamide 9T, polyamide MST, polyamide 612, poly-p-phenylene terephthalamide, and poly-m-phenylene isophthalamide.

2. The golf ball according to claim 1, wherein the cover has a surface hardness satisfying a hardness difference (HcsC−HcsD) between a hardness shown in Shore C hardness (HcsC) and a hardness shown in Shore D hardness (HcsD) of 27 or more.

3. The golf ball according to claim 1, wherein the resin composition constituting the cover contains an ionomer resin as a resin component, and the cover has a thickness (Tc) ranging from 0.5 mm to 1.3 mm.

4. The golf ball according to claim 1, wherein the intermediate layer has a thickness (Tm) ranging from 0.7 mm to 1.5 mm.

5. The golf ball according to claim 1, wherein the surface hardness (HmsC) of the intermediate layer ranges from 93 to 100 in Shore C hardness.

6. The golf ball according to claim 1, wherein the surface hardness (HmsD) of the intermediate layer ranges from 66 to 80 in Shore D hardness.

7. The golf ball according to claim 1, wherein the resin composition constituting the intermediate layer has the bending stiffness (Sm) ranging from 3000 kgf/cm$^2$ to 9000 kgf/cm$^2$.

8. The golf ball according to claim 1, wherein the surface hardness (HcsC) of the cover ranges from 91 to 98 in Shore C hardness.

9. The golf ball according to claim 1, wherein the surface hardness (HcsD) of the cover ranges from 58 to 72 in Shore D hardness.

10. The golf ball according to claim 1, wherein the resin composition constituting the cover has the bending stiffness (Sc) ranging from 1500 kgf/cm$^2$ to 6000 kgf/cm$^2$.

11. The golf ball according to claim 1, wherein the hardness difference (Hm−Hc) is 20 or less in Shore D hardness.

12. The golf ball according to claim 1, wherein the ratio (Sm/Sc) is 5 or less.

13. The golf ball according to claim 1, wherein the spherical core has a center hardness (Ho) ranging from 15 to 50 in Shore D hardness.

14. The golf ball according to claim 1, wherein the spherical core has a surface hardness (Hs) ranging from 35 to 70 in Shore D hardness.

15. The golf ball according to claim 1, wherein the spherical core has a hardness difference (Hs−Ho) between a surface hardness (Hs) and a center hardness (Ho) thereof ranging from 10 to 40 in Shore D hardness.

16. The golf ball according to claim 14, wherein a difference (Hm−Hs) between the material hardness (Hm) and the surface hardness (Hs) is more than 0 and 20 or less in Shore D hardness.

17. The golf ball according to claim 14, wherein a difference (Hc−Hs) between the material hardness (Hc) and the surface hardness (Hs) is more than 0 and 20 or less in Shore D hardness.

18. The golf ball according to claim 1, wherein the spherical core has a diameter ranging from 36.5 mm to 42.2 mm.

19. The golf ball according to claim 4, wherein a mass ratio (ionomer resin/polyamide resin) of the ionomer resin to the polyamide resin ranges from 90/10 to 50/50.

20. The golf ball according to claim 1, wherein the resin composition constituting the cover contains an ionomer resin and a thermoplastic styrene resin as a resin component.

* * * * *